US006877831B2

(12) United States Patent
Timmerman et al.

(10) Patent No.: US 6,877,831 B2
(45) Date of Patent: Apr. 12, 2005

(54) HOUSING FOR FREE-STANDING FILE CABINET

(75) Inventors: David H. Timmerman, Nunica, MI (US); Joanna C. De Weerd, Fennville, MI (US); Chad Potinsky, Holland, MI (US); William L. Cleair, Holland, MI (US); Eric Hill, Paw Paw, MI (US)

(73) Assignee: Haworth, Inc., Holland, MI (US)

( * ) Notice: Subject to any disclaimer, the term of this patent is extended or adjusted under 35 U.S.C. 154(b) by 2 days.

(21) Appl. No.: 10/328,736

(22) Filed: Dec. 23, 2002

(65) Prior Publication Data

US 2004/0119389 A1 Jun. 24, 2004

(51) Int. Cl.[7] ..... A47B 88/00
(52) U.S. Cl. ..... 312/351; 312/257.1; 312/334.8
(58) Field of Search ..... 312/257.1, 263, 312/350, 351, 330.1, 334.7, 334.8, 216, 217, 220

(56) References Cited

U.S. PATENT DOCUMENTS 1,569,158 A * 1/1926 Tobey ..... 312/240
1,934,644 A * 11/1933 Rand ..... 312/263
2,686,704 A * 8/1954 Wolters ..... 312/257.1
3,716,284 A * 2/1973 Vogt ..... 312/334.4
3,819,245 A 6/1974 Tacke
4,432,590 A 2/1984 Lawrence et al.
4,692,984 A 9/1987 McKernan et al.
4,712,844 A * 12/1987 Fry ..... 312/265
4,971,404 A 11/1990 Klungle et al.
5,102,210 A 4/1992 Beals
5,251,974 A 10/1993 Beals
5,364,178 A 11/1994 Hofman et al.
5,775,786 A * 7/1998 Liebertz ..... 312/334.8
5,785,401 A 7/1998 Bowyer et al.
5,853,237 A 12/1998 Powell et al.
6,293,637 B1 9/2001 Anderson et al.

* cited by examiner

*Primary Examiner*—Peter M. Cuomo
*Assistant Examiner*—Stephen Vu
(74) *Attorney, Agent, or Firm*—Flynn, Thiel, Boutell & Tanis, P.C.

(57) ABSTRACT

A lateral file having a cabinet structure which provides improved rigidity against racking, including an improved base associated with a hollow boxlike housing. The base is preferably defined as a closed hollow box which extends across the bottom of the housing. The closed hollow box additionally has wall structure which defines closed tubelike channels extending lengthwise along opposite edges thereof.

26 Claims, 6 Drawing Sheets

HOUSING FOR FREE-STANDING FILE CABINET

FIELD OF THE INVENTION

This invention relates to a drawer-type storage cabinet, particularly a lateral file storage cabinet of the type used in offices and the like, and to an improved housing or casing for such cabinet so as to significantly improve strength and rigidity thereof relative to racking.

This invention also relates to a drawer-type storage cabinet, particularly a lateral file storage cabinet of the type used in offices and the like, and to an improved slotted upright which is attached to the cabinet side walls and detachably supports telescopic drawer slides for permitting all of the slide-engaging uprights to be of identical construction.

BACKGROUND OF THE INVENTION

Drawer-type storage cabinets, commonly referred to as vertical files or lateral files, are conventionally utilized in offices and the like for storage of papers and other documents. The storage cabinet known as a lateral file is commonly and frequently utilized since the dimensional relationship of such file contributes to its being more user friendly. More specifically, such lateral file has the length of the file drawer extending generally parallel with the open side of the housing, whereby the housing has an overall depth which is generally significantly less than the length thereof. This enables the individual drawers to be more readily accessible throughout the full length thereof, and at the same time the drawers when extended outwardly into an open position are cantilevered outwardly through a lesser extent than is experienced when opening the drawer of a conventional vertical file.

More specifically the lateral file, as a result of its geometric arrangement, has an upright hollow housing defined generally by parallel upright side walls which are rigidly joined together by top and bottom walls, and which are typically joined by a back wall, the latter frequently being a thin metal sheet. The front side of the upright hollow housing is defined by a large access opening which occupies substantially the entirety of the front side, whereby a plurality of horizontally movable drawer units are supported in vertically superimposed relationship within the interior of the housing whereby the drawer fronts are positioned vertically one above the other so as to close off the front access opening. This overall geometric relationship, coupled with the desire to minimize the thickness of the individual walls and provide an exterior appearance having desired aesthetics, has necessarily resulted in a casing or housing which typically has less strength and rigidity than desired. Because of this, such lateral files have typically exhibited significant "racking" when subjected to load. That is, the housing tends to angularly deflect sidewardly relative to its base, whereby the side walls lose their perpendicular relationship with respect to the base, and the overall operation and appearance of the file is impaired. This racking becomes particularly significant when the lateral file is relatively high since the geometry of the file, for example its lateral or length dimension being typically two to three times its depth dimension, when coupled with an overall height dimension which is large when the file is four or five drawers high, results in the top of the file being laterally displaced a significant distance relative to the base.

Drawer-type storage cabinets of the type described above also typically utilize a construction wherein the cabinet side walls have opposed pairs of front and rear uprights secured thereto and provided with vertical rows of openings or slots for mounting the telescopic slides which are used for individually slidably supporting the drawers for opening and closing movement. A conventional practice for constructing the cabinet involves the use of four different uprights, namely right and left front uprights which are mirror images of one another and have rows of openings therein, as well as right and left rear uprights which are also mirror images of one another and have rows of elongate slots formed therein. These four uprights are all uniquely different from one another and are individually secured, typically welded, to the inner surface of the cabinet sidewall. The use of four different uprights significantly increases manufacturing complexity by increasing the number of different parts required, and the overall handling and sequencing thereof during assembly.

In an effort to somewhat simplify the construction, some conventional cabinets have identical right and left rear uprights so that only three different parts are required. To accomplish this, however, each of the rear uprights is provided with two vertically extending rows of elongate slots associated therewith, only one of which is used depending upon whether the upright is mounted on the right side versus the left side of the cabinet. While this construction hence does somewhat reduce the number of different parts, nevertheless it increases the manufacturing complexity of the rear upright by requiring forming of two slot rows therein, only one of which is used when the upright is assembled to the cabinet. Current cabinet constructions, whether they use three different or four different uprights, hence involves a significant number of different parts which hence complicates the overall manufacturing process.

Accordingly, it is an object of this invention to provide an improved housing or cabinet structure for a drawer-type file, particularly a lateral file, which overcomes or at least significantly improves the strength of the file housing so as to significantly minimize the racking problem conventionally encountered when the file is under load.

More specifically, this invention relates to an improved lateral file having an improved housing or cabinet structure which provides improved rigidity so as to minimize lateral displacement or racking of the housing structure under load, with the improved racking resistance being achieved principally through an improved base wall structure which is rigidly associated with the hollow boxlike housing. The bottom wall structure of the present invention is preferably defined as a closed but generally hollow box which extends across the bottom of the housing and has a thin vertical profile. The closed hollow box additionally has wall structure which defines closed tubelike channels extending lengthwise along at least opposite edges thereof, whereby the box provides significant strength with respect to vertical or downward compression loads imposed thereon, and in addition possesses strength and rigidity to more thoroughly rigidify the hollow boxlike housing so as to significantly minimize lateral racking thereof.

In the improved lateral file of the present invention, as aforesaid, the closed boxlike structure defining the bottom wall of the housing is defined solely by upper and lower boxlike members which are each open on one side. The open boxlike members are disposed in opposed relationship and nested one within the other, and rigidly joined together, to define a generally closed but hollow box which, when rigidly secured to lower edges of the side and back walls of the casing, provide improved resistance against lateral racking of the housing.

In the improved lateral file of this invention, as aforesaid, the opposed and nested upper and lower box members also have edge flanges extending around each of the members, which edge flanges cooperate with the opposite member to define, within the interior of the closed box, a closed tubelike channel structure which extends longitudinally along each of the edges of the box so as to provide the closed box with significantly increased strength and rigidity in both the lengthwise and widthwise dimensions thereof.

In the improved closed box structure defining the bottom wall of the housing, as aforesaid, the closed box structure is defined in its entirety by two members, namely the opposed upper and lower box members, which facilitates both economy and efficiency of manufacture and assembly, and in addition the two box members can be constructed of different thickness materials (for example different gauge sheet metal) so as to optimize strength versus cost and weight.

It is a further object of this invention to provide an improved housing or cabinet structure for a drawer-type file, particularly a lateral file, which provides improved efficiency of manufacture and construction due to the use of four identical uprights for defining the opposed pairs of front and rear uprights which support the telescopic drawer slides, whereby only a single upright member is required for manufacture and the same upright can be used as a front or rear upright on either the right or left sides of the cabinet. The upright utilizes and provides only a single row of openings extending vertically therealong for cooperating with the front or rear of either the right or left drawer slide, thereby decreasing the number of different parts required, and facilitating efficient manufacture and assembly of the cabinet.

More specifically, this invention relates to an improved lateral file having an improved housing or cabinet structure which has identical front and rear uprights fixed to the inner surfaces of each of the right and left side walls of the cabinet, with each upright having an identical single vertically-extending row of openings therethrough so that each upright is capable of engaging either a front or rear tab associated with an elongate housing of either the right or left telescopic drawer slide. The front and rear uprights, which are all preferably of channel-like cross section, are secured as by welding to the respective side wall so that the front uprights are disposed on opposite sides of the cabinet in opposed relationship adjacent the front opening, whereas the rear uprights are disposed in opposed relationship adjacent the rear side of the cabinet. The drawer slide housing has a first horizontally projecting tab which projects rearwardly adjacent the rearward end thereof for insertion into one of the openings associated with a rear upright, and has a front downwardly-projecting tab for projection through an identical opening associated with the front upright to stationarily and stably secure the telescopic slide to the uprights.

Other objects and purposes of the present invention will be apparent to persons familiar with constructions of this general type upon reading the following specification and inspecting the accompanying drawings.

Figure 1:
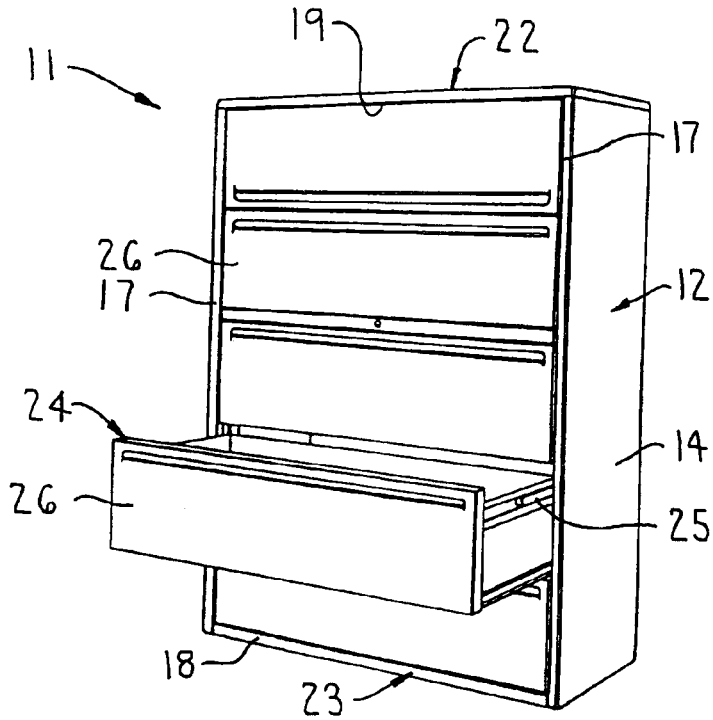
FIG. 1 is a perspective view of a free-standing cabinet, specifically a drawer-type lateral file cabinet.

Certain terminology will be used in the following descriptions for convenience in reference only, and will not be limiting. For example, the words "upwardly", "downwardly", "rightwardly" and "leftwardly" will refer to directions in the drawings to which reference is made. The word "front" will refer to that side of the cabinet having an access opening which accommodates the drawer fronts. The words "inwardly" and "outwardly" will refer to directions toward and away from, respectively, the geometric center of the cabinet and designated parts thereof. Said terminology will include the words specifically mentioned, derivatives thereof, and words of similar import.

DETAILED DESCRIPTION

Referring to FIGS. 1–5, there is illustrated a free-standing drawer-type file cabinet 11, commonly known as a lateral file cabinet, according to the present invention. The cabinet 11 includes an upright hollow boxlike housing 12 having a substantially planar upright back wall 13 and opposed substantially parallel upright side walls 14, the latter being joined to the back wall by rear corners 15. The side walls 14, at their forward edges, in the illustrated embodiment, have rounded front corners 16 defining narrow vertically-extending front edge strips 17 which are associated with the front side or wall 18 of the housing 12. The front edge strips 17 define a large front opening 19 therebetween which provides access to the hollow interior 21 of the boxlike housing. This front opening 19 extends horizontally and vertically over substantially the entirety of the respective width and height of the front wall except for narrow wall strips defined around the periphery thereof, such as defined by the vertical front strips 17. The housing 12 also includes top and bottom wall structures 22 and 23, respectively, which are fixed to and close off opposite ends of the housing.

The housing 12 mounts thereon a plurality of horizontally slidable drawer units 24, with a typical lateral file cabinet normally employing from two to five such drawer units positioned generally vertically one above the other within the housing. Each drawer unit 24 is conventionally horizontally slidably supported for movement relative to the housing 12 by a pair of conventional telescopic slide devices 25 which connect between the side walls 14 of the housing and the opposed respective side walls of the drawer unit 24. The drawer unit 24 also has a front wall 26 which, when the drawer unit is in a closed position, is disposed within the front cabinet opening 19 so as to be substantially flush with the front wall 18. The telescopic support devices 25, however, enable the individual drawer units 24 to be horizontally slidably moved outwardly through the front opening 19 into an open position, such as depicted by one of the drawer units in FIG. 1, to provide access to the interior of the drawer unit.

Figure 2:
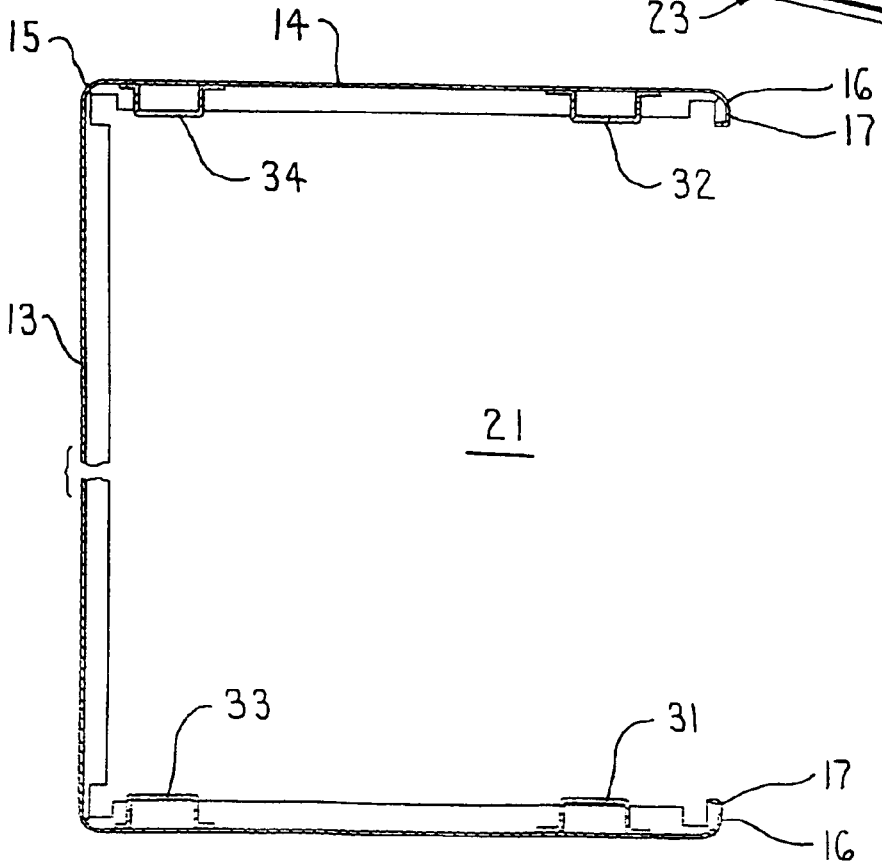
FIG. 2 is a horizontal cross-sectional view showing the U-shaped configuration of the fabricated sidewall structure of the cabinet.
Figure 3:
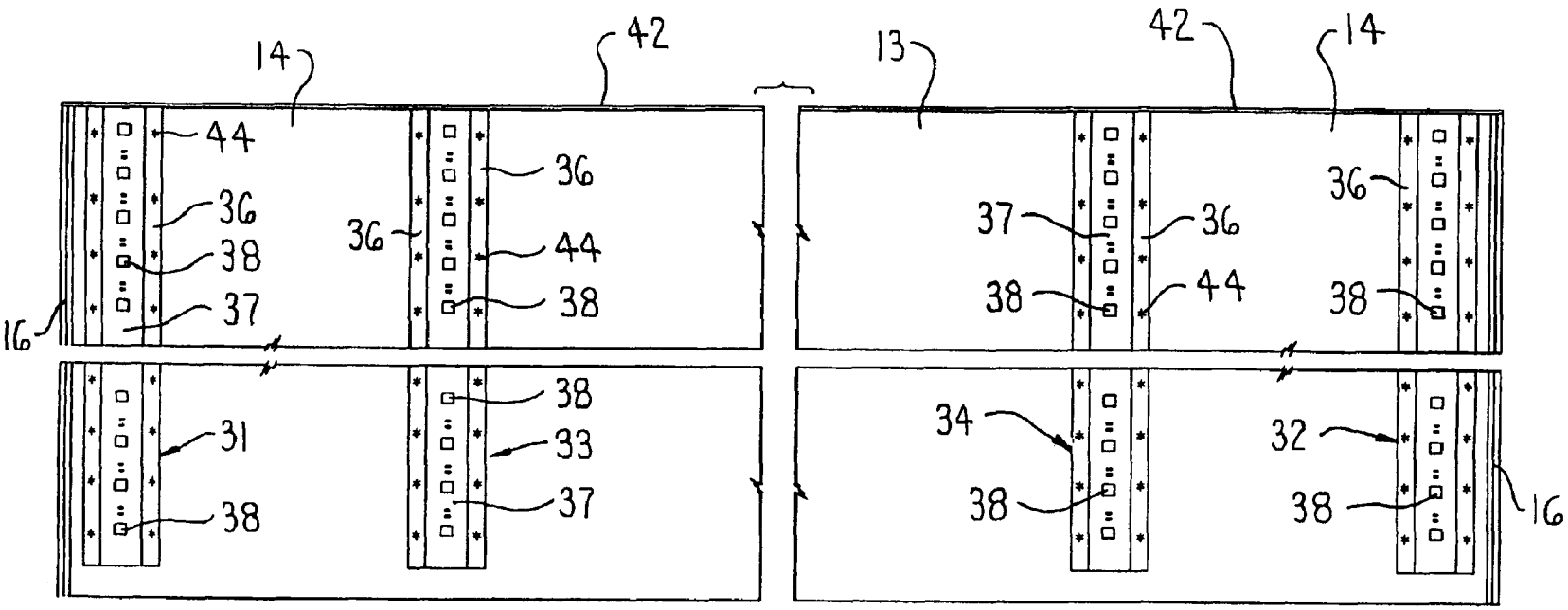
FIG. 3 illustrates the sidewall structure partially fabricated but prior to being bent into a U-shape.

The sidewall structure of the housing 12 as defined by the rear wall 13 and side walls 14 is, in the illustrated embodiment, initially formed in one piece from a flat steel sheet which is suitably folded and deformed to define the rear and side walls, with the sheet being suitably bent to define the rear corners 15 and hence result in the rear and side walls being of an upright U-shaped configuration substantially as illustrated in FIG. 2.

The overall construction of the file cabinet 11, as described above, is conventional. Reference is made to U.S. Pat. No. 4,692,984, owned by the Assignee hereof, for further description of this conventional construction.

To provide support for the horizontally slidable drawer units 24, the housing 12 fixedly mounts therein a plurality of uprights 31–34 which are fixed to and project vertically along the inner sides of the side walls 14 so as to provide engagement points for the telescopic slide units 25. More specifically, front uprights 31 and 32 are secured to the respective housing side walls 14 in closely adjacent relationship to the front side of the housing, with these uprights 31 and 32 being disposed in opposed or facing relationship. In similar fashion a pair of rear uprights 33–34 are secured to the side walls 14 in opposing relationship adjacent the rear wall 13. The uprights all extend vertically in generally parallel relationship throughout substantially the entire vertical extent of the interior of the housing.

In accordance with the present invention, all of the uprights 31–34 are identical, and each is defined generally as a main U-shaped channel 37 which opens toward the respective side wall 14, with the channel 37 having securing flanges 36 which extend lengthwise therealong and project transversely outwardly therefrom. These side flanges 36 seatingly abut the inner surface of the respective side wall 14 to permit fixed securement of the channel to the side wall, such as by a series of spot welds 44. The base wall 39 of the U-shaped channel is spaced inwardly a small distance from the respective side wall 14 to define a small clearance therebetween. The base wall 39 has a series of small openings 38 formed therethrough, which openings are disposed in generally uniformly vertically spaced relationship and are oriented to define a vertically extending row positioned generally along the vertically extending centerline 35 of the upright.

Figure 4:
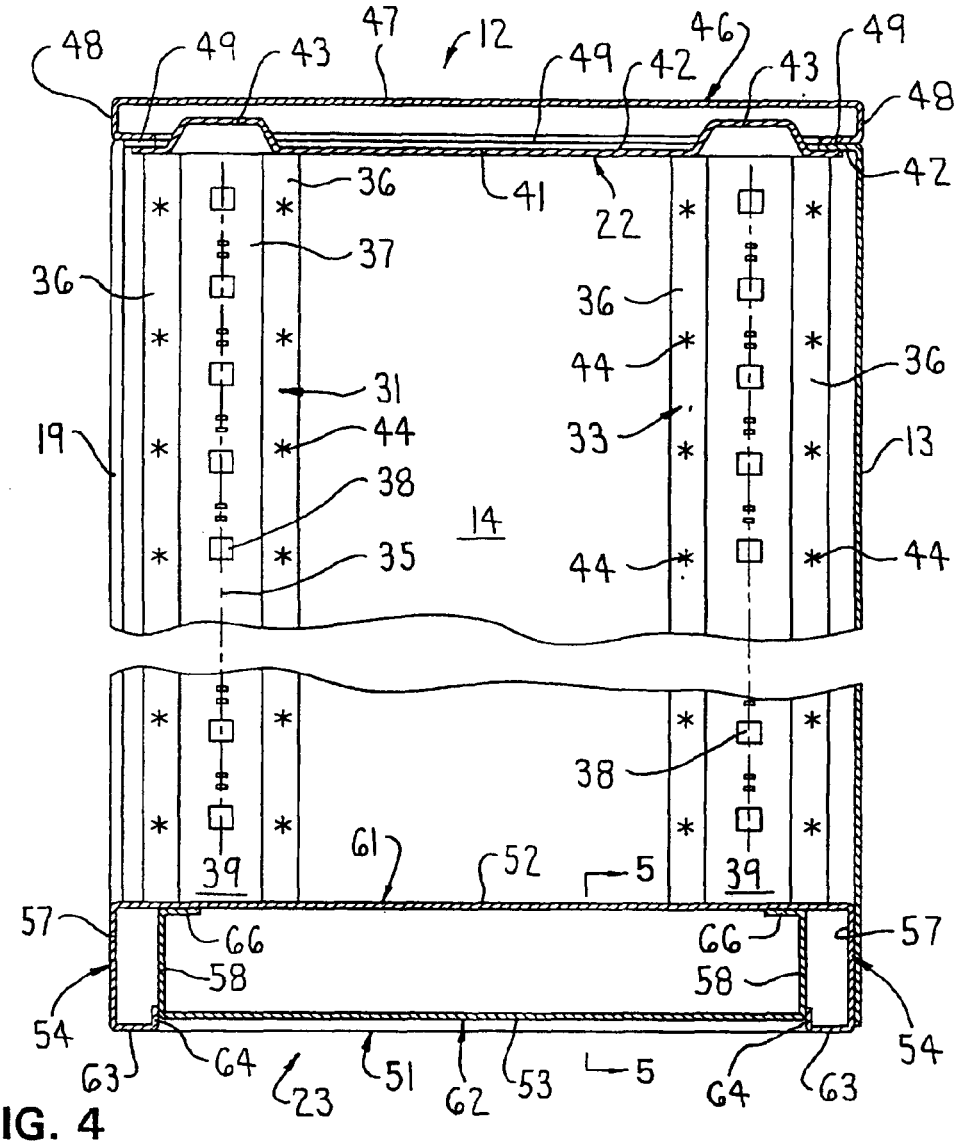
FIG. 4 is an enlarged upright cross-sectional view taken transverse to the front side of the cabinet and shown with the drawers removed.

The identical uprights 31–34 each have a generally hat-shaped cross-section and, since each has an identical configuration which is symmetrical about the respective vertically extending centerline 35 thereof, each upright can be utilized to define either a front or rear upright on either of the right or left side walls 14 of the housing. When mounted on the housing side walls, substantially as illustrated by FIG. 4, the lower ends of the uprights are positioned so as to substantially engage an upper surface of the bottom wall structure 23, as described in detail hereinafter.

The top wall structure 22 as associated with the housing 12 includes a horizontally enlarged platelike top wall 41 which extends longitudinally between the upper edges of the side walls 14, and has a transverse width which horizontally extends throughout the depth of the housing. This top wall 41 is positioned so that the peripheral edge portions thereof are disposed directly under top edge flanges 42 (FIG. 4) which are associated with the upper edges of the rear wall 13 and side walls 14 and are bent so as to project horizontally inwardly through a small extent. The top housing flanges 42 hence overlie peripheral edge portions of the top wall 41 and are suitably fixed thereto, such as by spot welding.

The top wall 41 is preferably provided with a pair of upwardly-protruding channel-like ribs 43, the latter extending in the longitudinal direction of the housing so as to extend perpendicularly between the parallel side walls 14. The channel-like ribs 43 in the illustrated embodiment are positioned so that the longitudinal centerlines thereof respectively intersect the vertical centerlines of the uprights 31–34. Ribs 43 provide top wall 41 with significantly increased strength and rigidity, which top wall in turn when welded to the top flanges associated with the housing back and side walls hence in turn closes off the upper end of the housing to provide a rigidified structure.

The cabinet housing 12 also includes a top cover member 46 which fixedly but detachably secures to the upper end of the housing 12. This top cover member 46 is formed generally as a one-piece open box which opens downwardly, and which can be suitably formed from a single metal sheet. The cover member 46 includes a horizontally extending platelike top wall 47 which extends coextensively over the longitudinal and depth dimensions of the housing. This top wall 47, at its peripheral edges, is bent downwardly to define a peripheral edge wall 48 which extends entirely around the periphery of the top wall and which projects vertically downwardly through only a small vertical extent. The edge wall 48 in turn at its lower end is bent inwardly to define a cantilevered edge flange 49 which is inturned horizontally and which is adapted to be seatingly engaged on top of the top edge flanges 42 associated with the housing walls 13 and 14. The overlapping flanges 42 and 49 are suitably fixedly secured together, typically by screws or other suitable fasteners (not shown) so as to fixedly attach the cover member 46 to the housing 12.

Considering now the bottom wall structure 23 and referring specifically to FIGS. 4–8, this bottom wall structure or base 23 is defined by a closed but hollow box structure 51 which is of small vertical extent but has horizontal dimensions in the longitudinal and depth directions so as to correspond to the horizontal cross section of the housing. The closed box structure 51 includes generally parallel top and bottom walls 52 and 53, respectively, which extend horizontally and are disposed in vertically spaced relation. The top and bottom walls 52–53 in turn are rigidly joined together by horizontally elongate tubular wall arrangements 54 which extend lengthwise along the front and rear longitudinally extending edges of the base, with similar elongated tubular wall arrangements 56 extending lengthwise along the peripheral end (i.e. depthwise) edges of the base. The tubular edge wall arrangements 54 and 56 hence effectively define the periphery of the base and extend in surrounding relationship thereto.

Each of the tubular edge wall arrangements 54 and 56 is defined generally by an outer upright wall 57 which extends vertically throughout the height of the base and defines the longitudinally extending outer peripheral edge wall along each of the front, back and end edges of the base. The tubular wall arrangements 54, 56 also each include an inner upright wall 58 which extends generally parallel with but is spaced inwardly a small distance from the respective outer upright wall 57, with the transverse spacing between the cooperating parallel upright walls 57 and 58 being smaller than the height of these walls in the illustrated and preferred embodiment. The cooperating upright walls 57 and 58 extend generally throughout the vertical height of the base and suitably cooperate with the top and bottom walls of the base to thereby define a substantially closed tubular structure having a generally rectangular cross section, which tubular structure extends throughout substantially the entire length of each of the longitudinal and transverse edges of the base.

The base 51 as briefly described above in effect includes an inner hollow closed box defined by the inner upright walls 58 and their extension between the top and bottom walls 52–53, with this inner closed hollow box being effectively surrounded by the horizontally elongate tubular edge structures 54 and 56 which extend along all of the peripheral edges of the box and which in cooperation with the top and bottom walls 52–53 also effectively define a closed but hollow box.

The closed hollow box 51 according to the present invention is preferably constructed substantially in its entirety from two preformed members, namely upper and lower open box members 61 and 62, respectively, each of which is preferably formed from a suitable flat metal sheet. The upper and lower box members are oriented so that the openings therein are oriented so as to face one another, and these upper and lower box members are sized so that they effectively vertically telescope together whereby the one box member (i.e., the lower box member) effectively nests into the other box member (i.e., the upper box member).

The upper box member 61 is defined by the top wall 52 and the outer upright edge walls 57, with the latter edge walls 57 at their lower ends being suitably deformed inwardly to define inwardly projecting bottom flanges 63 which are generally horizontally oriented so as to be parallel with and displaced vertically downwardly from the top wall 52. The bottom flanges 63 project inwardly only a small horizontal extent, and the inner edges thereof are suitably bent upwardly to define upwardly cantilevered guide flanges 64 which project vertically upwardly through only a small vertical extent and terminate at a free edge. The guide flanges 64 extend generally parallel with and are spaced inwardly a small distance relative to the respective outer upright side flange 57. The construction of the top box member 61, including the top wall 52, outer upright walls 57, bottom flanges 63 and guide flanges 64, are all preferably of a one-piece monolithic structure which is suitably shaped from a flat metal sheet.

The lower box member 62 is defined by the horizontally enlarged bottom wall 53 and the inner upright walls 58 which project upwardly from around the rectangular peripheral edge of the bottom wall 53. The peripheral edge walls 58 of the lower box member, at their upper ends, are bent inwardly to define top flanges 66 which are cantilevered horizontally inwardly and terminate at inner free edges. The lower box member 62, as defined by the bottom wall 53, upright edge walls 58 and top flanges 66, are all preferably formed as a one-piece monolithic structure, such as by being suitably formed from an appropriate flat metal sheet.

Figure 5:
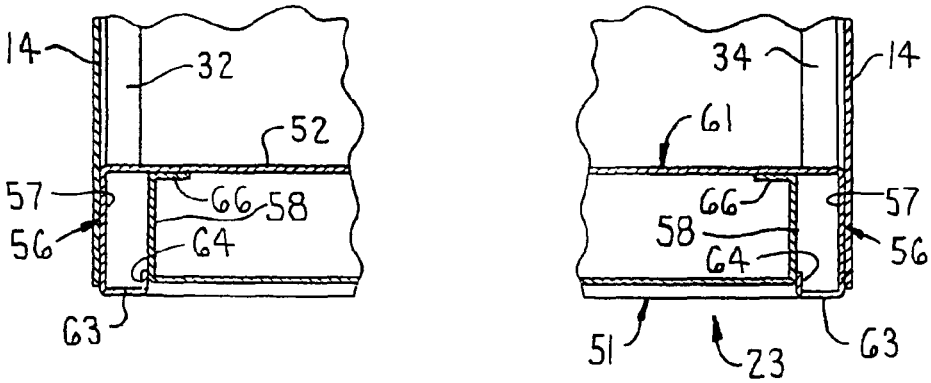
FIG. 5 is a fragmentary sectional view through the base of the cabinet and taken generally along line 5—5 in FIG. 4.
Figure 6:
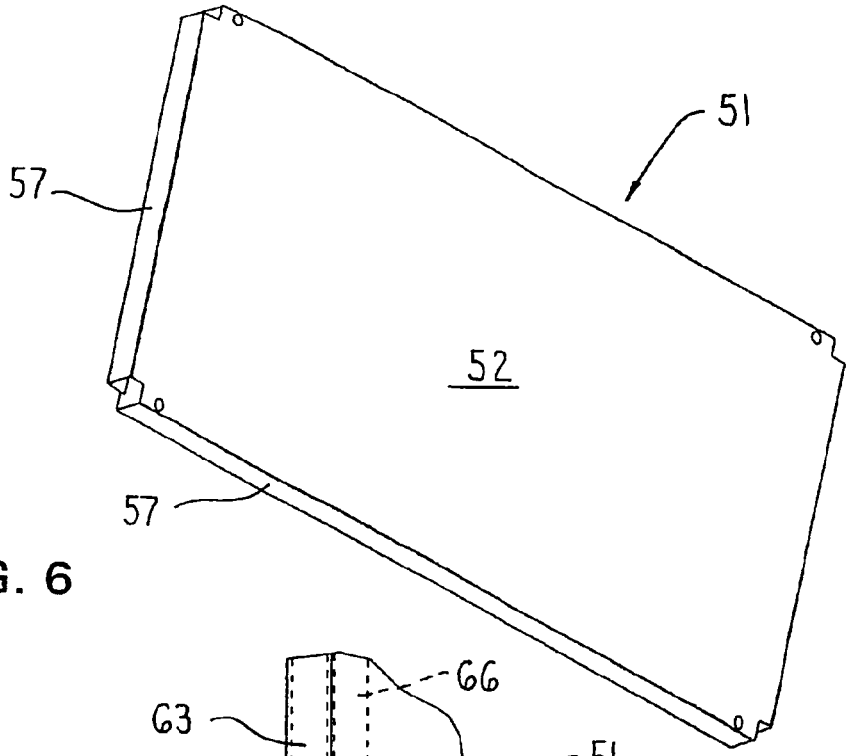
FIG. 6 is a perspective view showing solely the base or boxlike bottom wall structure of the cabinet.

As illustrated by FIGS. 4–5, the upper and lower box members 61 and 62 are sized such that the horizontal exterior cross section of the lower box member 62 substantially corresponds to the interior horizontal cross section defined interiorly of the upper box 61, namely the cross sectional interior defined by the guide flanges 64, whereby the lower box 62 can be slidably inserted into the inverted upper box 61 through the opening defined by the guide flanges 64, with the top flanges 66 on the lower box seating or abutting against the underside of the top wall 52. When so seated, the peripheral upright walls 58 of the inner box, in the vicinity of the bottom wall 53, are disposed effectively in slidably engaged relationship with the inner surfaces of the guide flanges 64. The guide flanges 64 and the adjacent wall structure of the inner box 62 are suitably welded together during assembly of the base so that the inverted nested boxlike members 61 and 62 are hence fixedly joined and hence effectively define a closed hollow boxlike arrangement.

As further illustrated by FIGS. 4–5, the lower box member 62 preferably has a depth which is slightly less than the depth of the upper box member 61 so that, when the box members nest together with the flanges 66 seated against the top wall 52, the bottom wall 53 of the lower box member is preferably spaced upwardly a small distance above the bottom flanges 63 associated with the top box member 61. This hence ensures that the rectangular floor-engaging footprint defined by the lower surfaces of the bottom flanges 63 is hence the primary area which (if the cabinet is not provided with separate glides or feet) can be used for supportive engagement with a floor. Further, this slight upward disposition of the bottom wall 53 relative to the bottom flanges 63 also facilitates the weldment of the bottom box 62 to the guide flanges 64.

Figure 7:
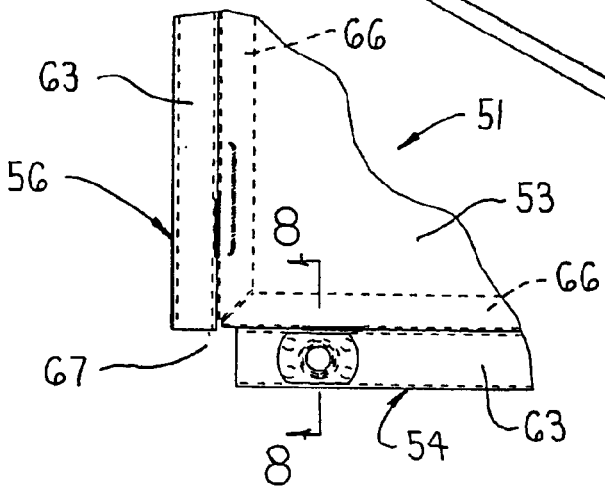
FIG. 7 is a fragmentary view showing solely one corner of the base as appearing from the underside thereof.
Figure 8:
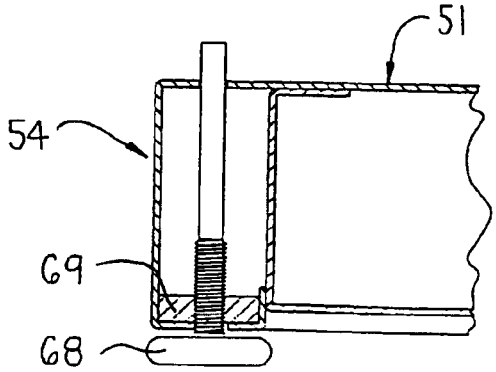
FIG. 8 is a fragmentary sectional view taken generally along line 8—8 in FIG. 7.
Figure 9:
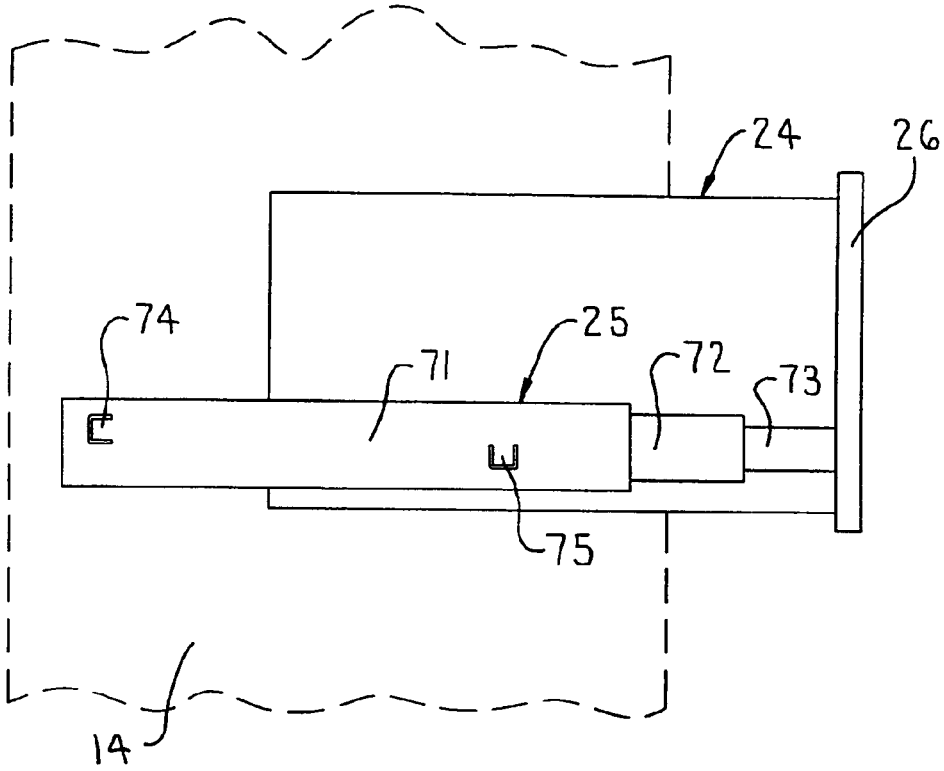
FIG. 9 diagrammatically illustrates a drawer in a partial open condition relative to the cabinet, and showing diagrammatically the drawer slide which interconnects one side of the drawer to an adjacent side wall of the cabinet.
Figure 10:
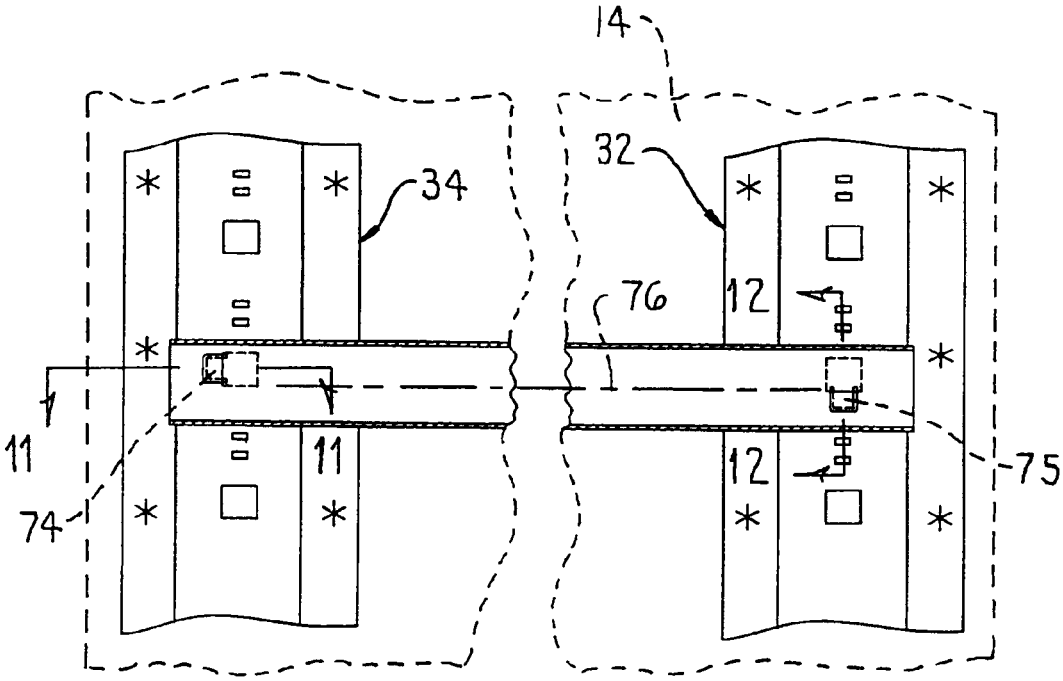
FIG. 10 diagrammatically illustrates a drawer slide attached to a pair of uprights associated with one side wall of the cabinet.
Figure 11:
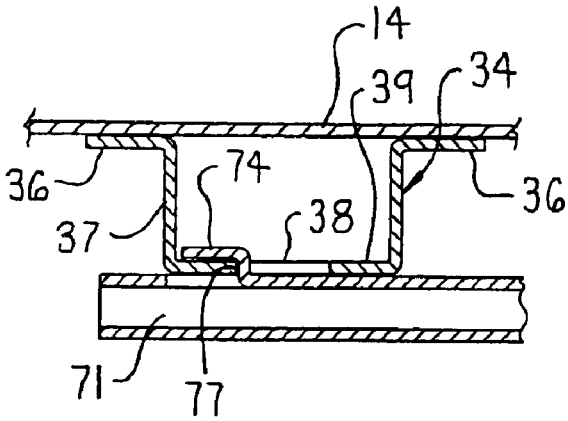
FIGS. 11 and 12 are enlarged, fragmentary sectional views taken along lines 11—11 and 12—12, respectively, in FIG. 10.
Figure 12:
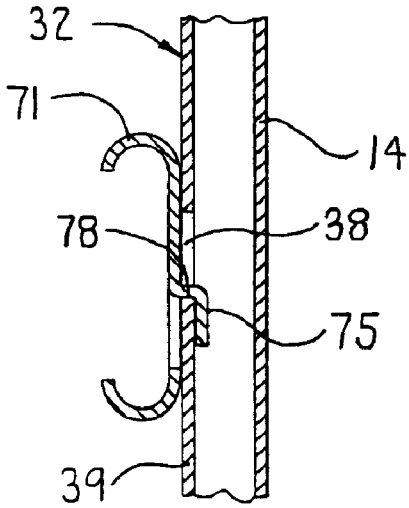

The base 51 is preferably provided with a suitable floor-engaging glide or foot associated with each corner thereof. In this respect, one such glide is illustrated in FIGS. 7–8 wherein the glide 68 is positioned directly below the tubular edge structure 54 of the base closely adjacent one end thereof. The glide 68 has an upwardly projecting shaft which protrudes upwardly through the tubular wall structure 54 and is suitably threadably engaged into and through a nut structure 69 which is fixed to the tubular wall structure. The glide 68 hence can be adjusted vertically to permit proper leveling. At the same time the glide 68 and its disposition under and adjacent each end of the front and rear tubular wall structures 54 hence enables the glides to be disposed closely adjacent the front and rear sides of the cabinet, in the vicinity of the corners thereof, so as to optimize the stability and support of the cabinet when disposed in a normal upright supportive engagement with a floor.

In the illustrated construction of the housing, the base 51 as illustrated in FIG. 7 preferably has a recess 67 defined at each corner thereof, which recess 67 is created by effectively terminating the front tubular structure 54 such that it does not project all the way to the outer peripheral edge of the tubular edge wall structure 56. The corner recess 67 accommodates the upright rounded front corner 16 associated with the sidewall arrangement of the housing, and also accommodates the rounded rear corner 15 where the rear and side walls join, inasmuch as the housing side and rear walls project vertically downwardly so as to overlap the exterior peripheral walls of the base substantially as illustrated in FIGS. 4 and 5.

To effect assembly of the base to the housing wall structure 13–14, the upper box member 61 is positioned within the lower end of the U-shaped wall structure defined by rear wall 13 and side walls 14 such that the lower peripheral edge portions of these latter walls overlap the side and rear peripheral upright walls 57 as illustrated in FIGS. 4–5. These overlapping walls are then suitably secured together, such as by spot welding. The latter is preferably carried out from inside the hollow upper box 61. Thereafter the lower box 62 is slidably nested inside the upper box 61 and maintained with the top flanges 66 thereof seated against the top wall 52, following which the lower box 62 is welded to the guide flanges 64 to rigidly join the nested boxes 61–62 together, with the resulting box structure itself being rigidly joined to the upright side and rear walls associated with the housing.

With the construction of the housing 12 as described above, the definition of the housing by the rear and side walls and the securement thereof to the hollow boxlike base 51, together with the securement of the side and rear walls to the top wall 41, accordingly defines the housing as a generally large but hollow box which is open on the front side thereof, but which hollow box possesses significant strength and rigidity so as to permit it to accommodate significantly heavy loads as imposed thereon by loaded drawer units 24, while at the same time resisting significant racking or transverse displacement of the housing. The closed boxlike structure of the base 51, and specifically the provision of the closed tubular wall structures 54 extending longitudinally along the front and rear edges of the base, provides the base with a high degree of rigidity such that the base when coupled to the side and rear walls of the housing hence cooperate to provide a high degree of stiffness which greatly minimizes the tendency of the top of the housing to laterally displace (i.e. rack) relative to the base. At the same time the closed edge wall structures 56 which extend lengthwise along the end edges, namely in the depth direction of the housing, are disposed directly under the uprights 31–34 on which the load-bearing drawer units are supported, and these tubular edge wall structures 56 additionally are secured to the lower portions of the side walls 14, whereby the base additionally provides increased strength and rigidity with respect to transference of loads into the base and thence into the floor-engaging glides 68 so as to minimize deflection or distortion of the housing.

The construction of the base 51, by forming same from opposed nested upper and lower box members 61 and 62, is further advantageous by not only simplifying the construction of the base and the number of parts utilized to form the base, but by also permitting optimization with respect to the selection of material and/or material thickness. For example, the upper and lower box members 61 and 62 are each preferably formed as monolithic one-piece structures by being formed from thin metal sheet, but these two box members can be formed from different gauge or thickness of metal sheet. In this respect, it is preferable that the upper box member 61 be initially formed from metal sheet having a greater thickness than that utilized to define the lower box member. In a preferred construction the upper box member 61 is formed from 18 gauge steel sheet, whereas the lower box member 62 is formed from 22 gauge steel sheet.

Considering now the mounting of the drawer slides on the uprights 31–34, and referring specifically to FIGS. 9–12, there is illustrated the disposition of a drawer slide 25 as associated with one side of a drawer unit 24, and specifically the positioning of the drawer slide relative to the front and rear uprights 32, 34 associated with one of the side walls 14.

The drawer slide 25 includes an outer channel-like housing or rail 71 which is adapted to be stationarily mounted on and extend horizontally between the front and rear rails 32, 34. This outer rail 71 telescopically and slidably mounts therein an intermediate slide 72, the latter in turn telescopically slidably mounting therein an outer slide 73, the latter being fixed to the side wall of the drawer unit in a conventional manner.

The overall construction of the telescopic slide 25 is conventional, and may assume many known conventional constructions so that further description thereof is believed unnecessary.

To mount the telescopic slide 25 on the uprights in accordance with the housing construction of the present invention, the vertical wall of the slide rail 71 is provided with a rear mounting flange 74 and a front mounting flange 75 which are respectively configured to engage the respective rear upright 34 and front upright 32. The rear mounting flange 74 is integrally formed from the rail 71 and is joined to the rail through an offset wall 77 so that the rear mounting flange 74 is cantilevered rearwardly from the offset 77 and is spaced sidewardly a small distance from the outer surface of the rail 71.

In similar fashion the front mounting flange 75 is formed integral with and offset outwardly from the outer side of the rail 71. For this purpose the front mounting flange 75 is joined to the rail through an offset wall 78, with the flange 75 being cantilevered so as to project in a downward direction from the offset wall 78. The front flange 75 projects generally downwardly relative to the horizontal or longitudinally extending centerline 76 of the slide rail 71, whereas the rear mounting flange 75 is disposed so that it is oriented generally above the centerline 76.

The mounting flanges 74–75 are adapted for cooperation with the identical openings 38 provided in the front and rear uprights 32, 34, which openings are rectangular and in the disclosed embodiment are square. The identity of the uprights 32, 34 and their disposition within the housing results in the individual openings 38 in the front rail 32 being generally horizontally aligned with their respective individual openings 38 in the rear upright 34.

To mount the slide unit 25 to the respective side wall 14, the slide rail 71 is oriented horizontally and is positioned closely adjacent the uprights such that the rear mounting flange 74 is generally aligned with a selected one of the openings 38 in the rear upright 34. The slide rail 71 is then moved toward the uprights so that the rear flange 74 passes through the aligned opening 38, following which the rail 71 is moved rearwardly so that the flange 74 overlaps behind the base wall of the upright, causing the rear edge of the opening 38 to effectively abut the offset wall 77. When in this disposition, the slide rail 71 is angled slightly upwardly as it projects forwardly so as to cause the front flange 75 to align with a corresponding opening 38 in the front upright 32. The front end of the rail 71 is then moved inwardly so that the front flange 75 passes through the aligned opening 38. The rail 71 is then tilted downwardly about the rearward end thereof, thus causing the front flange 75 to pass downwardly,into overlapping relationship behind the base wall of the upright 32, which downward tilting continues until the bottom edge of the opening 38 effectively abuts the offset wall 78. When reaching this latter position, the front and rear flanges are hence properly seated on the respective front and rear uprights, and can not be readily dislodged except by reversing the sequence of motions described above.

It will be appreciated that right and left slide rails 71 are effectively mirror images of one another so as to be engageable with the uprights on the respective right and left side walls 14.

While the construction of the housing 12 associated with the disclosed embodiment involves forming the rear and side walls from one piece of metal sheet, it will be appreciated that the housing can also be formed from side and rear walls which are initially separate elements and which are suitably joined together during assembly of the housing, and that the improved base as well as the improved uprights as disclosed herein are particularly suitable for use with a housing employing separately-formed side and rear wall constructions. In addition, it will be further appreciated that the closed box base need not be provided with corner recesses, depending upon the configuration of the side and rear wall structures, and in fact maintaining solid corners on the base in most circumstances is preferred since such solid corners provide additional reinforcement for the housing at the corners.

With the drawer-type storage cabinet of the present invention, it will be appreciated that such cabinet will typically have a width (i.e., the longitudinal extent of the cabinet as defined between the opposed side walls) which is typically at least two to three times greater than its depth (i.e., the transverse front-to-back dimension), and such cabinet when used in a typical three-to-five drawer arrangement will have a height which will be in the range of from two to four times the cabinet depth.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. An upright multiple-drawer storage cabinet, comprising:

a rigid upright housing defining therein a hollow interior, said housing having a pair of generally parallel upright side walls which at upper and lower ends are rigidly joined by respective top and bottom wall arrangements and which are secured to a rear wall for closing off a rear side of the housing, the housing on a front side thereof being defined by a front access opening which extends both vertically and horizontally over a substantial majority of the front side of the housing for allowing access to the hollow interior thereof;

a plurality of storage drawers disposed vertically one above the other and being individually movably supported on the housing for movement between closed positions wherein the drawers are disposed within the housing interior and open positions wherein the drawers project horizontally outwardly through the front access opening, said drawers having drawer fronts which substantially occupy and close off the front access opening when all of the drawers are in the closed position, said storage drawers being disposed vertically between said top and bottom wall arrangements; and said bottom wall arrangement being defined by a closed but rigid hollow box structure which defines the horizontally extending footprint of the housing for supportive engagement with a floor, the hollow box structure having top and bottom walls which extend generally parallel and are spaced vertically a small space apart to define an open interior therebetween, and peripheral edges of said top and bottom walls being rigidly joined by an edge structure which extends peripherally around the closed box structure, said edge structure as it extends along a pair of generally parallel edges of said closed box structure being defined by an elongate tubular structure which extends horizontally lengthwise along the respective edge generally between said top and bottom walls.

2. The storage cabinet according to claim 1, wherein said edge structure includes a horizontally elongate tube defined at and extending horizontally along each of the peripheral edges of the closed box structure so that the tube structures define a generally rectangular frame disposed around the peripheral edge of the box structure and defined between the top and bottom walls thereof.

3. The storage cabinet according to claim 1, wherein said closed box structure is defined in its entirety by two formed members, one of which comprises an open box, said two formed members being vertically fixedly joined to define the open interior therebetween.

4. The storage cabinet according to claim 3, wherein each of said members is monolithically formed from thin metal sheet.

5. The storage cabinet according to claim 1, wherein the closed box structure is defined by an upper box member which opens downwardly and a lower box member which opens upwardly, said upper and lower box members being vertically nested together to define said open interior therebetween.

6. The storage cabinet according to claim 5, wherein each of said box members comprises a monolithic one-piece member.

7. The storage cabinet according to claim 5, wherein the upper and lower box members have respective peripheral edge flanges which project vertically so that the edge flanges on one box member nest vertically within the edge flanges of the other box member, the edge flanges of the upper and lower box members being horizontally spaced so that when the box members are vertically nested together the edge flanges cooperate with the top and bottom walls to define said elongate tubular structure which extends lengthwise along each of the respective edges of the closed box structure.

8. The storage cabinet according to claim 1, wherein the edge structure includes a horizontally elongate tube defined at and extending horizontally along each of front and rear peripheral edges of the closed box.

9. The storage cabinet according to claim 1, wherein said edge structure includes a horizontally elongate tube defined at and extending horizontally along each end peripheral edge of the closed box structure, said tube being disposed directly adjacent and fixedly secured to a lower portion of the adjacent side wall which exteriorly vertically overlaps the tube.

10. A storage cabinet according to claim 1, wherein the closed box structure is defined by a one-piece upper box member which opens downwardly and a one-piece lower box member which opens upwardly, said upper and lower box members being vertically telescopically nested one within the other and fixedly secured together to define said open interior therebetween;

one of said box members having a generally rectangular horizontal base wall and peripheral edge flanges which project vertically away from the base wall at each of said peripheral edges thereof, said peripheral edges including a vertically peripheral upright wall which at an end remote from the base wall is joined to a cantilevered horizontal flange which protrudes inwardly in parallel relationship to the base wall;

said other box member having a generally rectangular base wall which is joined at peripheral edges thereof to peripheral flanges which protrude vertically and which at opposite edges are joined to seating flanges which are cantilevered horizontally, the peripheral flanges on said other box member being guidably confined within an opening defined by the peripheral edge flanges on said one box member so that said seating flanges on said other box member abut an inner surface of the base wall defined by said one box member, the upright flanges on said one box member being oriented generally parallel with and spaced outwardly from the respective peripheral flanges associated with said other box member so as to define said horizontally elongate tube along the peripheral edge of the closed box structure.

11. In an upright multiple-drawer storage cabinet having an upright side wall structure defining an interior compartment in which a plurality of horizontally-movable drawers are positionable vertically one above the other, and a horizontally-enlarged floor-engaging base structure fixed to and closing off a lower end of said upright side wall structure, the improvement wherein said base structure comprises a closed and hollow box structure having width and depth dimensions which are large relative to its height dimension, said box structure including generally horizontally enlarged top and bottom walls which are disposed in vertically spaced and generally parallel relationship, and peripheral edge walls of short vertical extent extending vertically between peripheral edges of said top and bottom walls and throughout substantially the length of the peripheral edge for rigidly joining the top and bottom walls together, said box structure also including a pair of generally parallel upright inner walls which are respectively positioned adjacent and spaced inwardly a small distance from a respective one of the peripheral edge walls and extending generally parallel therewith throughout substantially the lengthwise extent of the edge wall, said inner upright wall and its respectively adjacent peripheral edge wall cooperating with the top and bottom walls to define elongate tubular wall structures which extend lengthwise along a pair of parallel peripheral edges of the base structure.

12. The cabinet according to claim 11, wherein said hollow box structure is formed in its entirety from two separate members.

13. The cabinet according to claim 12, wherein one of said members is defined by a horizontally enlarged box member which opens vertically, and wherein the other member closes off the open region defined by the box member.

14. The cabinet according to claim 12, wherein each of said two separate members is monolithically formed from thin metal sheet.

15. The cabinet according to claim 11, wherein said base structure is defined by a first vertically-opening one-piece box member which telescopically slidably fits with a second vertically-opening one-piece box member, each box member being formed in one-piece from a flat metal sheet.

16. The cabinet according to claim 15, wherein said second box member opens upwardly, said first box member is positioned uppermost and opens downwardly, and said second box member is telescoped upwardly into the interior of said first box member.

17. In an upright file cabinet having a plurality of horizontally movable drawers or shelves supported within an upright housing, and a horizontally enlarged floor-engaging base located below said movable drawers or shelves and fixed to and closing off a lower end of the upright housing, the improvement wherein said horizontally enlarged base includes a first one-piece shallow box member having a horizontally enlarged top wall and a vertically short peripheral edge wall projecting downwardly therefrom, a second upwardly-opening shallow box member having a horizontally enlarged bottom wall and a vertically short peripheral edge wall projecting upwardly therefrom, said first and second box members being telescoped one within the other and rigidly joined to define a unitary closed box structure, the peripheral vertical walls associated with one of the box members being disposed adjacent but spaced outwardly a small distance from the peripheral walls of the other box member to define closed tubular wall structures of generally rectangular cross section along each of the peripheral edges of the closed box structure.

18. The cabinet according to claim 17, wherein said second box member telescopes upwardly into the interior of said first box member.

19. The cabinet according to claim 18, wherein each of said first and second box members are one-piece monolithic members formed from thin metal sheet.

20. The cabinet according to claim 17, wherein each of said first and second box members are one-piece monolithic members formed from thin metal sheet, and wherein said first box member is formed from metal sheet having a thickness greater than the thickness of the metal sheet used for forming the second box member.

21. An upright multiple-drawer storage cabinet, comprising:

an upright hollow housing having an upright sidewall structure including generally parallel but sidewardly spaced upright side walls which adjacent rear edges are joined by an upright rear wall, the housing defining therein an interior chamber, a front side of the housing defining therein an access opening for accessing said interior chamber;

front and rear vertically elongate and parallel uprights fixed to an inside surface of each of said upright side walls so that the front and rear uprights on one said side wall are disposed generally in opposed and facing relationship to the respective front and rear uprights fixed to the opposite side wall;

each of said front and rear uprights being identical to one another and having a plurality of vertically-spaced openings extending horizontally therethrough with said plurality of openings being disposed generally within a vertically extending row which is disposed generally along a longitudinal centerline of the upright, whereby the openings formed in the uprights face inwardly toward the opposed side wall; and a plurality of horizontally movable drawer units positioned within the interior chamber of the housing in vertically adjacent relationship one above the other, each said drawer unit having a pair of horizontally elongate slide units fixed to opposite sides thereof, and each of said slide units having a rail structure provided with front and rear engagement flanges which respectively engage in one of the openings respectively associated with the front and rear uprights associated with the adjacent side wall of the housing;

wherein the rear engagement flange is cantilevered rearwardly and has a horizontal rearward engagement with an opening associated with the rear upright, and the front engagement flange is cantilevered vertically downwardly for engagement with an opening of the front upright.

22. The cabinet according to claim 21, wherein the rear engagement flange is disposed generally above a longitudinally extending centerline of the rail structure, and the front engagement flange is disposed generally below the horizontal centerline of the rail structure.

23. In an upright storage cabinet having an upright housing defining therein a storage compartment accessible through an opening defined in a front side of the housing, and a horizontally enlarged base fixed to and closing off a lower end of the upright housing, the improvement wherein said horizontally enlarged base includes a first one-piece shallow box member having a horizontally enlarged top wall and a vertically short peripheral edge wall projecting downwardly therefrom, a second upwardly-opening shallow box member having a horizontally enlarged bottom wall and a vertically short peripheral edge wall projecting upwardly therefrom, said first and second box members being telescoped one within the other and rigidly joined to define a unitary closed box structure, the peripheral vertical walls associated with one of the box members being disposed adjacent but spaced outwardly a small distance from the peripheral walls of the other box member to define closed tubular wall structures of generally rectangular cross section along each of the peripheral edges of the closed box structure.

24. The cabinet according to claim 23, wherein said second box member telescopes upwardly into the interior of said first box member.

25. The cabinet according to claim 24, wherein each of said first and second box members are one-piece monolithic members formed from thin metal sheet.

26. The cabinet according to claim 23, wherein each of said box members are one-piece monolithic members formed from thin metal sheet.

* * * * *